US007172479B2

(12) United States Patent
Poldervaart et al.

(10) Patent No.: US 7,172,479 B2
(45) Date of Patent: Feb. 6, 2007

(54) OFFSHORE PRODUCTION SYSTEM WITH DRILLING/WORKOVER RIG

(75) Inventors: Leendert Poldervaart, Castelleretto (MC); Bram Van Cann, Nice (FR); Leon D. Rosen, Los Angeles, CA (US)

(73) Assignee: Single Buoy Moorings, Inc., Houston, TX (US)

( * ) Notice: Subject to any disclaimer, the term of this patent is extended or adjusted under 35 U.S.C. 154(b) by 79 days.

(21) Appl. No.: 10/843,937

(22) Filed: May 12, 2004

(65) Prior Publication Data

US 2004/0244986 A1 Dec. 9, 2004

Related U.S. Application Data

(60) Provisional application No. 60/475,653, filed on Jun. 4, 2003.

(51) Int. Cl.
*B63B 21/50* (2006.01)

(52) U.S. Cl. ..... 441/5; 114/230.12; 166/355

(58) Field of Classification Search ..... 441/5; 114/230.12; 166/355
See application file for complete search history.

(56) References Cited

U.S. PATENT DOCUMENTS

| | | | | |
|---|---|---|---|---|
| 2,276,990 | A * | 3/1942 | Long | 414/626 |
| 4,436,048 | A * | 3/1984 | Gentry et al. | 114/230.12 |
| 4,637,335 | A * | 1/1987 | Pollack | 114/230.12 |
| 5,857,808 | A * | 1/1999 | de Baan | 405/224 |
| 6,093,068 | A * | 7/2000 | Turner et al. | 441/5 |

FOREIGN PATENT DOCUMENTS

WO WO 01/31164 A1 5/2001

* cited by examiner

*Primary Examiner*—Sunil Singh
(74) *Attorney, Agent, or Firm*—Leon D. Rosen

(57) ABSTRACT

An offshore hydrocarbon production system includes a vessel (12) with a turret (16), and a fluid swivel (50) on the turret that is connected to risers (41–43) that extend to the sea floor (26), wherein a drilling/workover rig (60) on the vessel can lower tubing (65) toward the sea floor without danger that the tubing will wrap about the risers when the hull weathervanes. The rig is mounted on the turret. Pipes (54) that extend from the rotatable part of the fluid swivel to fittings (55) on the hull (14), are supported on a gantry (80) that is fixed to the hull and having a gantry middle portion (106) that extends over the turret. The gantry middle portion extends higher than the top (88) of the rig.

10 Claims, 4 Drawing Sheets

OFFSHORE PRODUCTION SYSTEM WITH DRILLING/WORKOVER RIG

CROSS-REFERENCE

Applicant claims priority from U.S. Provisional Patent Application Ser. No. 60/475,653 filed Jun. 4, 2003.

BACKGROUND OF THE INVENTION

A vessel that is used to produce hydrocarbons from an offshore well commonly includes a turret that is moored to the sea floor. The vessel hull is rotatable about the turret so the hull can weathervane about the turret with changing winds, waves and currents. The turret can lie in a moon pool in the hull or can lie outboard of the hull such as beyond the bow of the hull. Risers that extend up from about the sea floor to the turret, have upper ends connected to a fluid swivel on the turret. It is common to provide a drilling/workover rig on the hull. The rig supports a tubular drill string that is used to drill wells in the sea floor. A second and later wells may be drilled while risers from previous wells continue to carry hydrocarbons up to the vessel. After wells are drilled and risers installed, the rig can continue to be used, as to support a string of tubing that is used for servicing the wells, as to clean away wax buildup.

One problem encountered in such use of a rig, is that tubing extending down from the rig has to be brought back up when the vessel weathervanes. Otherwise, the string extending down from the rig on the weathervaning hull could eventually wrap itself around the risers. Actually the string could damage the risers when first beginning to rub against them. It would be desirable if a rig was available on the vessel that could drill and/or perform workovers without the requirement for raising the string every time the vessel weathervanes by more than several degrees.

SUMMARY OF THE INVENTION

In accordance with one embodiment of the present invention, an offshore production system is provided of the type wherein one or more risers extend up to a fluid swivel stack on a turret that is moored to the sea floor and rotatably mounted on a vessel hull, and wherein a drill/workover rig is also provided. The invention avoids the need to raise a tubing extending down from the rig when the vessel weathervanes. The rig is mounted on the turret and spaced far from the axis of a group of riser portions at the bottom of the turret, so the string extending down from the turret does not wrap around or even rub against the risers, regardless of vessel weathervaning.

The upper ends of the risers are connected to nonrotatable parts of the fluid swivel stack. The rotatable parts of the fluid swivel stack are mounted on a gantry that is fixed to the hull and that has a gantry middle portion that lies higher than the top of the rig. The nonrotatable parts of the fluid swivel stack that lie high above the turret deck, can be supported on the turret by a structure extending up from the turret deck.

The upper ends of a plurality of risers can be connected together in a manifold to minimize the number of required fluid swivels. A reel of tubing can also be mounted on the turret.

The novel features of the invention are set forth with particularity in the appended claims. The invention will be best understood from the following description when read in conjunction with the accompanying drawings.

DESCRIPTION OF THE PREFERRED EMBODIMENT

Figure 1:
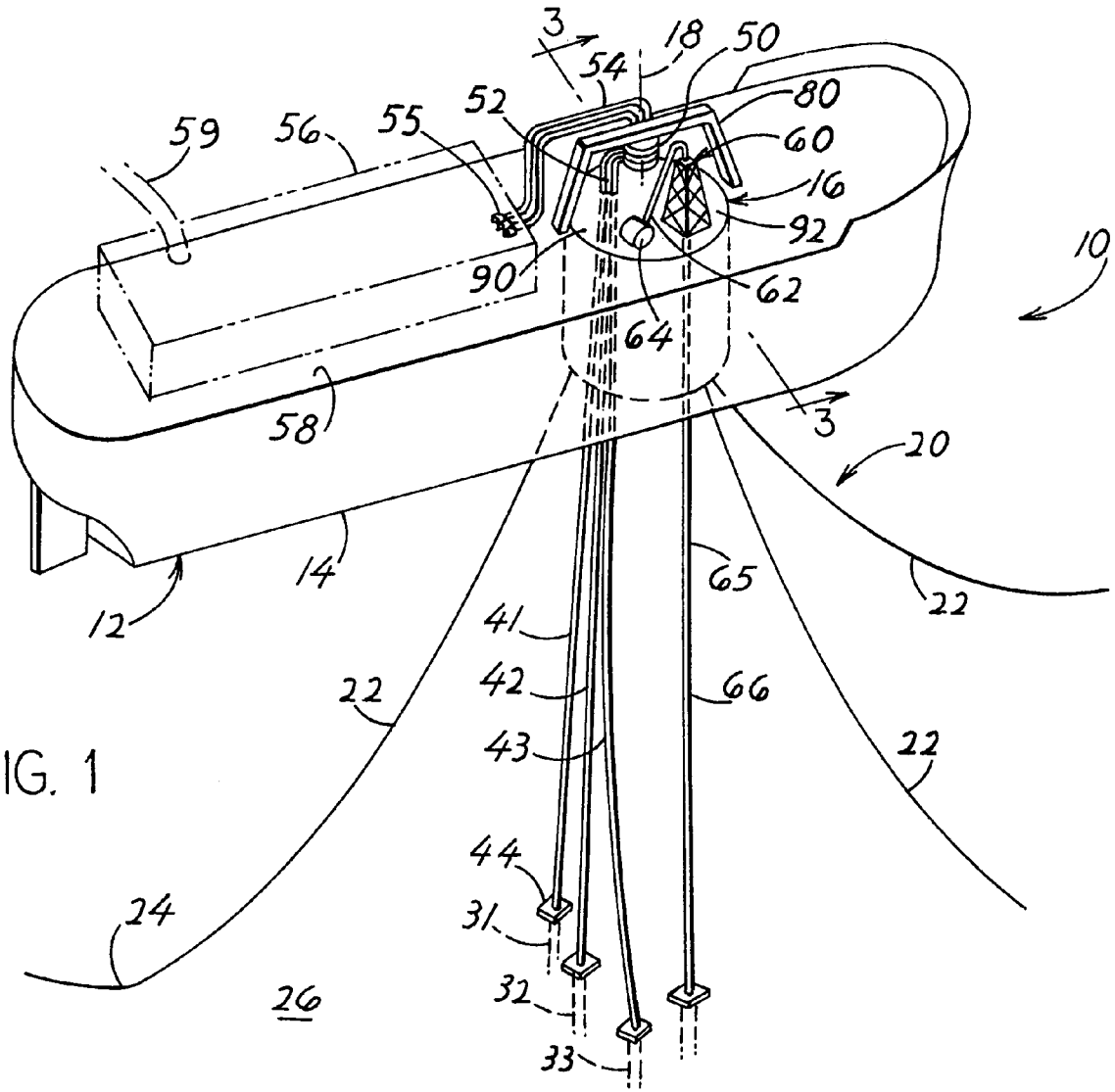
FIG. 1 is an isometric view of an offshore floating production system of one embodiment of the present invention.

FIG. 1 illustrates a system 10 for producing hydrocarbons from undersea wells, which includes a weathervaning floating structure 12 in the form of a vessel which has a hull 14 and a turret 16 that is rotatably mounted on the hull about a primarily vertical turret axis 18. The turret is moored to the sea floor by a mooring system 20 that includes a plurality of catenary chains 22 having upper ends attached to the turret and lower ends 24 lying on the sea floor 26. The floating structure, or vessel can drift a limited amount, and the hull can weathervane, that is, it can rotate about the axis 18 with changing winds, waves and currents.

Figure 3:
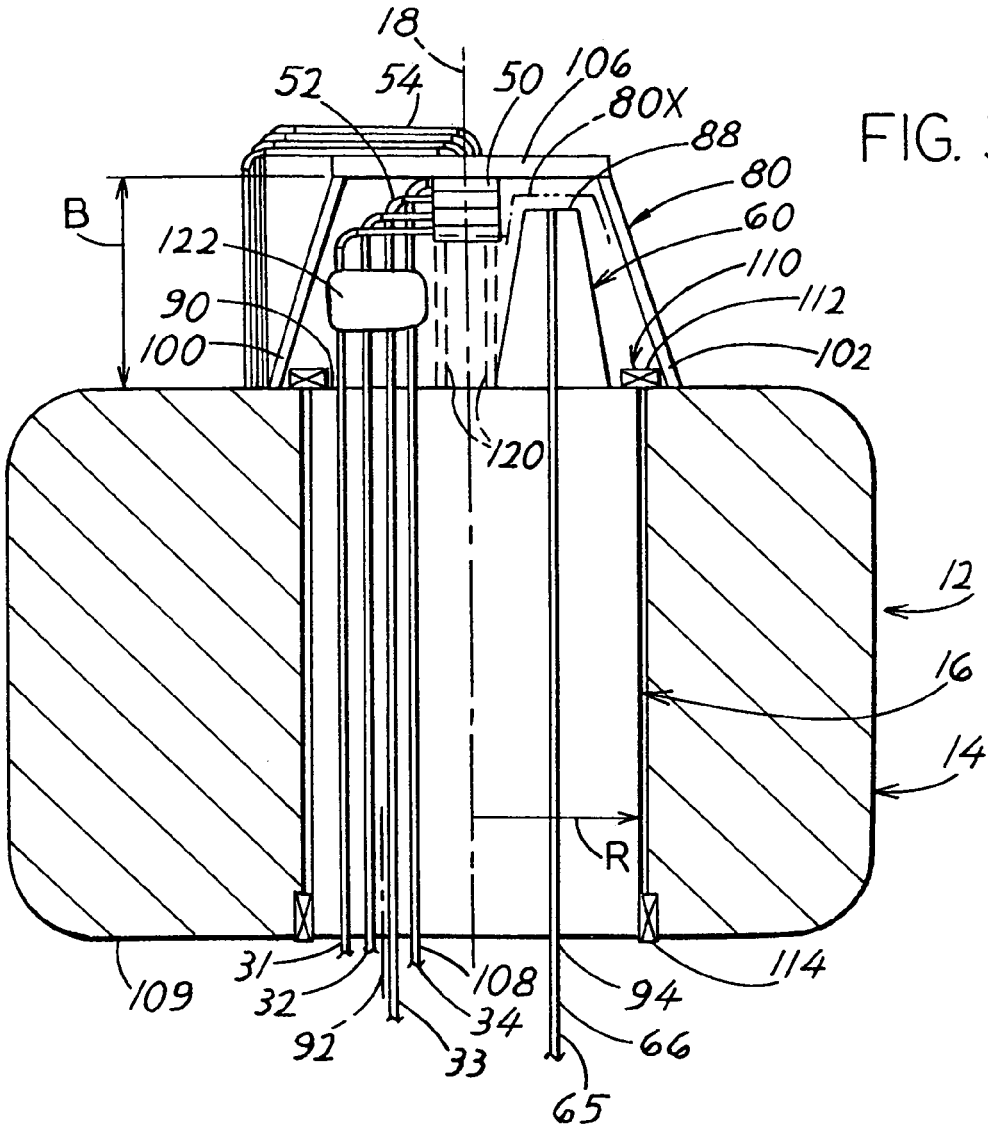
FIG. 3 is a sectional view of the hull and turret of the system of FIG. 2.

The system enables the production of hydrocarbons from several undersea wells. In FIG. 3 wells 31–33 are shown, and three risers 41–43 are shown extending up from platforms 44 on the seafloor where pipes extend down to the wells. The risers extend up through the turret to a swivel stack, or swivel device (a fluid swivel with at least one swivel) 50. The swivel device 50 comprises at least one and usually a stack of swivels with stationary outer swivel parts connected to riser upper ends 52. The swivels have rotatable swivel parts (that rotate with the vessel hull) that are connected to rotatable pipes 54 that rotate with the hull and that extend to pipe fittings 55 on the hull and to a processing facility indicated at 56 that lies on the deck of the hull 12. Processed hydrocarbons can be temporarily stored on the hull and offloaded through an export pipeline 59 that may lead to an on-shore facility, to a tanker that carries away the hydrocarbons, or to other similar structures. Alternatively, the produced hydrocarbons may be directly exported without first storing them.

The turret 16 can be said to be stationary, or nonrotatable, in that it can rotate only a limited amount (e.g. 20°) about the vertical turret axis 18, while the vessel is said to be rotatable in that it can weathervane (turn about axis 18) without limit. It is important that the axes of pivoting of the fluid swivels of the swivel device 50 lie on or very close to the axis 18. This assures that pipes 54 that connect to the pipe fittings 55 on the hull do not move radially, toward and away from the turret axis, as the hull weathervanes.

In accordance with the present invention, applicant provides a drilling and/or workover rig 60 which is mounted on the turret 16. The rig includes equipment that can lower a tubing 65, such as many tubes joined end to end to extend to about the sea floor, or a continuous tube that is stored on a large diameter reel 64. The rig lowers the tubing so it extends downward along a path 66 to about the sea floor 26. The rig also includes equipment that can rotate the tubing. The tubing may be used to drill, to clean a conduit, or for other purposes. In one system, a dedicated workover riser extending along path 66 is supported from the turret, and the tubing is lowered within the workover riser.

Figure 2:
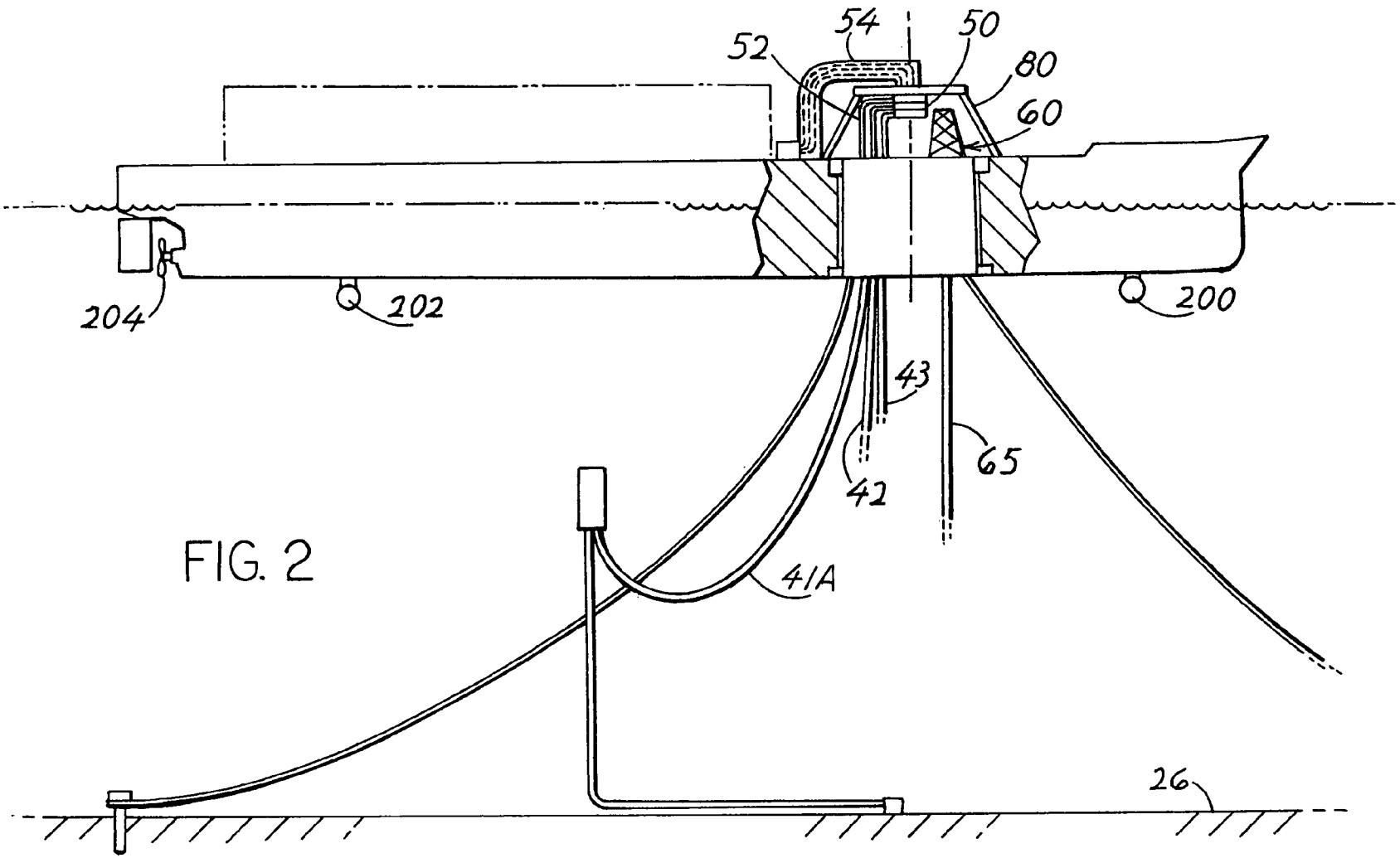
FIG. 2 is a partially sectional side view of the system of FIG. 1.

The great advantage of placing the rig on the turret 14 instead of on the hull 14, is that the tubing 65 extending down from the rig, then does not weathervane but remains largely stationary (with respect to rotation about the turret axis) along path 66 as do the risers at 41–43. Also, the upper ends of the tubing and of the risers drift at the same rate and in the same direction as the hull and turret drift. If the rig is not mounted on the turret but on the hull 14, then it is generally required that a tubing extending along a path similar to 66 be withdrawn whenever the vessel weathervanes by more than a limited amount. Otherwise, the tubing will begin to wrap about the risers 41–43 and rub against them, which can damage the risers. Thus, by placing the rig 60 on the turret 14 to which the upper ends of the risers are mounted, applicant enables drilling and/or workover and the like to continue while the vessel weathervanes, or at least allows the tubing at 65 to remain in place when the vessel weathervanes instead of requiring the tubing to be pulled up. The vessel can be provided with thrusters, shown at 200–204 in FIG. 2, for heading and position control, especially to limit drift and weathervaning in largely calm weather when there are only small to moderate forces on the hull.

Figure 5:
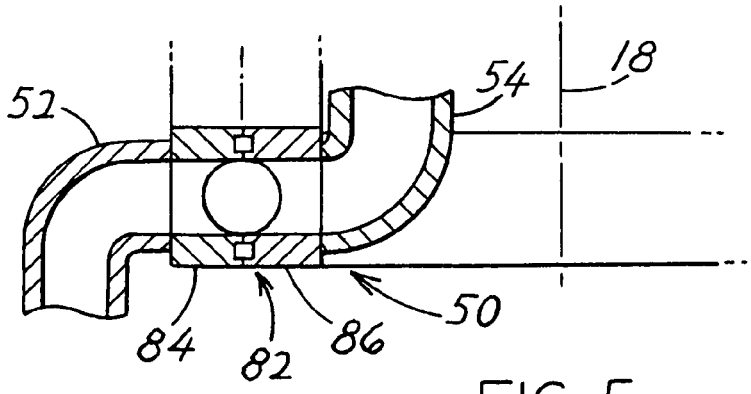
FIG. 5 is a sectional view of one side of a fluid swivel of the fluid swivel device of FIG. 3.

One problem that arises when a rig is placed on the turret, is that the nonrotating (no more than about 20°) rig can interfere with the rotating pipes 54 that extend from the rotating parts of the fluid swivels to the hull. As shown in FIG. 5, each fluid swivel such as 82 of the swivel device 50, includes an outer part 84 that is fixed to the turret and that connects to one of the riser upper ends 52*a*. The fluid swivel also has an inner part 86 that is rotatable in that it rotates with the hull when the hull weathervanes. The swivel inner part connects to one of the rotatable pipes 54 that extend to a fitting on the hull. Since the pipes rotate about turret axis 18, the pipes 54 (FIG. 3) could hit the rig 60 unless steps are taken to prevent this.

As shown in FIG. 3, applicant provides a gantry 80 to hold the rotatable pipes 54 above the top 88 of the rig 60. As a result, when the hull rotates so the pipes 54 would otherwise strike the rig, the pipes instead move above the rig. It would be possible to provide a system that moves rotatable pipe sections out of the way of the rig whenever interference is approaching, such as described in U.S. Pat. No. 5,205,768, but this can add complications. The gantry has opposite ends 100, 102 fixed to opposite sides of the turret, and has a middle portion 106 that lies over the turret at a height B above the top deck 90 of the turret. It would be possible to instead construct the gantry middle portion so only two parts of the middle portion lie above the rig top, as shown in phantom lines at 80X.

Figure 4:
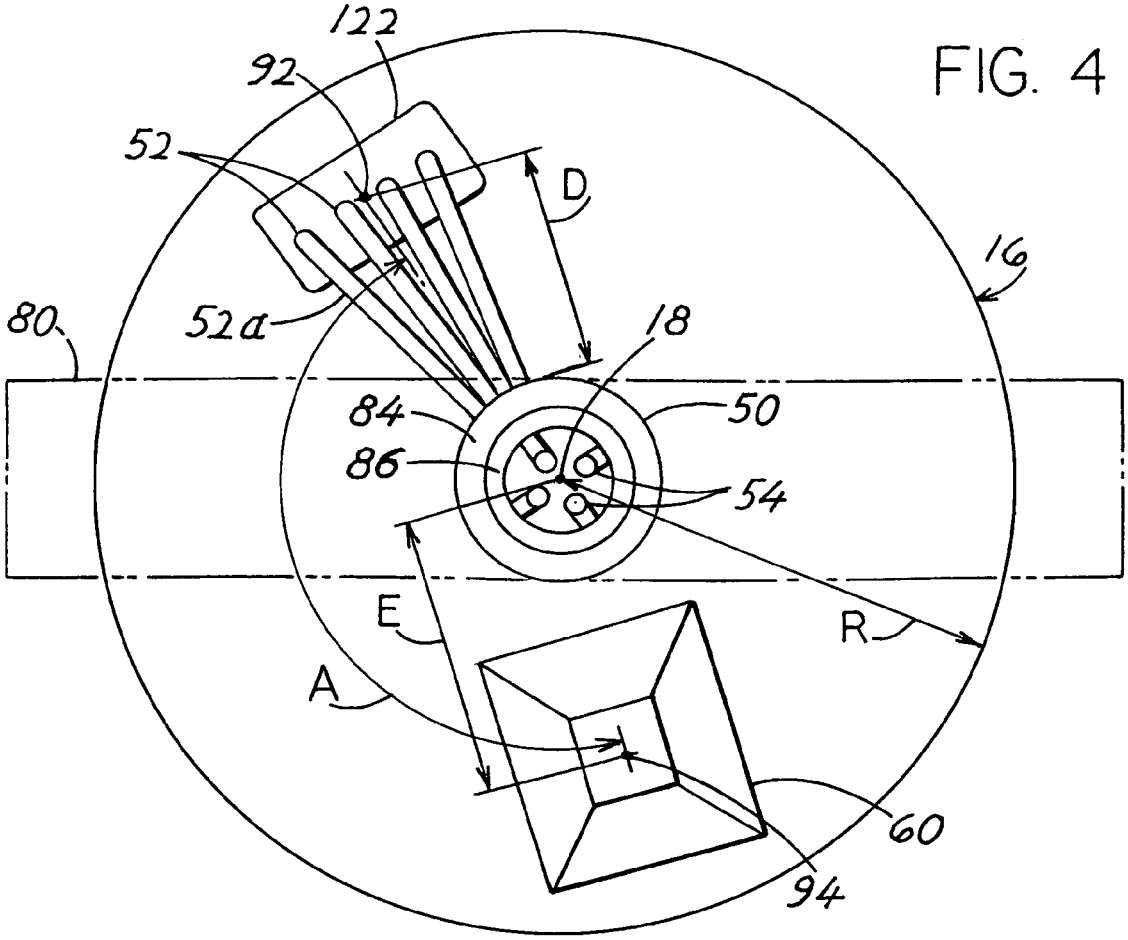
FIG. 4 is a plan view of the turret of FIG. 3.

FIG. 3 shows the fluid swivel device 50 supported on the gantry middle portion 106. The fluid swivel device is supported so the swivel inner parts 86 (FIG. 5) and rotatable pipes 54 are fixed to the gantry. The swivel outer parts 84 are each connected to a riser upper end 52. The riser upper ends 52*a* extend primarily horizontally by a distance D of at least one half the turret radius R, to one side of the turret axis 18 opposite the rig, so the riser middle portions 108 that lie at the bottom 109 of the turret, are widely spaced from the tubing 65 lowered by the rig. The rig 60 and its tubing that extends along the path 66 lie on a side of the turret axis that is opposite the riser middle portions that lie closely under the turret. As shown in FIG. 4, a riser axis 92 that is parallel to the turret axis and that extends through the middle of the group of risers at the bottom of the turret, is angled about the turret axis 18 by an angle A that is at least 90° and preferable close to 180° from the rig axis 94 along which the rig lowers tubing, to minimize the possibility that the tubing will rub against the risers. Preferably there is an angle A of at least 90° between the rig and the middle portion of each riser. By such angular separation, applicant can separate the portions 108, 94 (FIG. 3) of the risers and tubing that lie at the bottom of the turret, by at least the radius R of the turret.

As shown in FIG. 4, the upper portions 52 of the risers (below the horizontal upper ends 52*a*) lie a considerable distance D from the fluid swivel, in a direction away from the rig axis 94. This separates the riser portions at the bottom of the turret from the tubing extending along the rig axis. The distance D is at least half of the separation E between the rig axis and the turret axis 18. The separation of the riser axis 92 and rig axis 94 is preferably greater than the radius of the turret.

The gantry 80 (FIG. 3) is useful not only to support the stationary pipes and possibly the fluid swivel device, but can support a winch that can be used to lift tube sections that are lowered by the rig and to lift other heavy parts during their installation and afterwards. The turret is mounted on the hull 14 through a bearing assembly 110 that includes upper and lower bearings 112, 114. The turret has a large diameter on the order of magnitude of 25 meters. The turret can be rotatably supported on the hull through bogies and the like, because roller bearings are generally not available in such large diameters.

Although the riser upper portions 52 could be used to prevent rotation of the stationary outer fluid swivel parts 84 (FIG. 4) about the rotatable swivel inner part 85, applicant prefers to relieve stress on the riser upper ends by an antirotation structure such as the tubular structure shown at 120 in FIG. 3. The structure 120 extends between the main part of the turret 14 and the outer part of the fluid swivel device 50 to prevent their relative rotation.

FIG. 3 shows a manifold 122 that can merge the outputs of a plurality of risers, to reduce the required number of fluid swivels in the stack.

Figure 6:
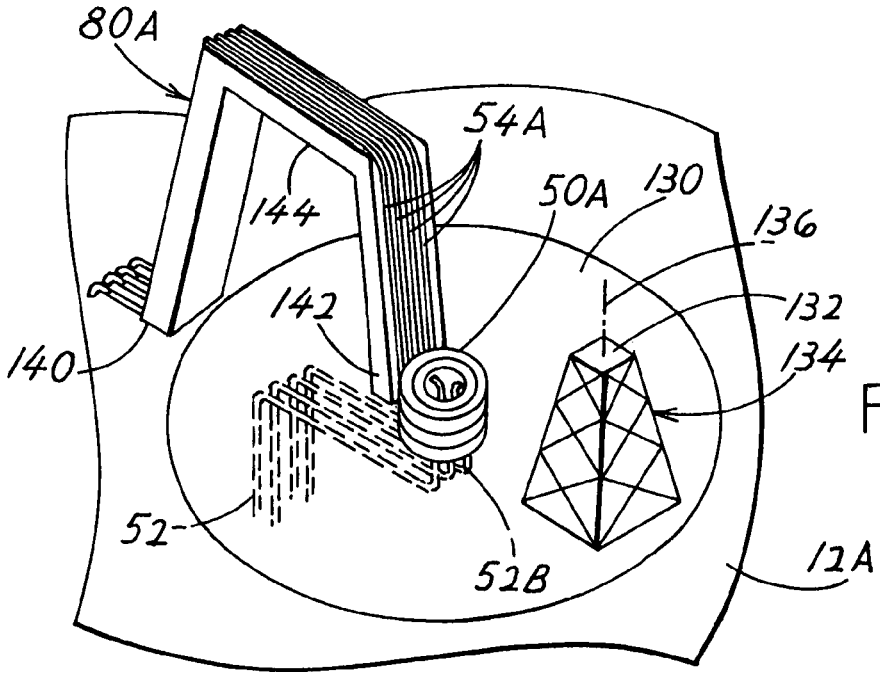
FIG. 6 is an isometric view of an upper end of a turret and a portion of the vessel hull of another embodiment of the invention.

FIG. 6 illustrates another arrangement, wherein the fluid swivel device 50A is fixed to a deck 130 of the turret and the extreme upper ends 52B of the risers are connected to inner swivel parts of the fluid swivels. The outer swivel parts are connected to rotatable pipes 54A that are supported by a gantry 80A of another construction. The gantry 80A has one end 140 that is fixed to the hull 12A and has an opposite end 142 that is cantilevered. A gantry middle portion 144 lies high above the turret deck 130 to pass over top 132 of the rig 134 when the hull weathervanes so the gantry middle lies directly over the rig. This construction has the advantage that the gantry and rotatable pipes move directly over the rig only half as often as the gantry of FIGS. 1–5. Although the tubing extending down along the rig axis 136 from the rig does not have to be pulled up every time the rig moves under the gantry, the movement of another section of tubing as to the top of the rig may have to be stopped at that time if there is not a large vertical separation between the gantry and rig. Thus by constructing the gantry with only one part that may lie over the rig, the need to stop certain operations of the rig are reduced. It would be possible to mount the gantry outer end 142 though a bearing onto the turret to support the gantry outer end, but this can complicate the construction.

In a system of the type shown in FIG. 3 that applicant has designed, the turret had a radius R of 12.5 meters. The derrick 60 requires a height of a plurality of meters (although the derrick could be recessed below the turret deck to allow a lower gantry top). The illustrated derrick extends 13 meters above the turret top deck 90.

Thus, the invention provides an offshore hydrocarbon production system of the type that includes a floating structure (which is herein referred to as a vessel) having a weathervaning hull, a moored nonrotatable turret that is supported by bearings on the hull, and a rig that can lower tubing for drilling or workover towards the sea floor, which avoids the need to raise the tubing to avoid damage to risers as the hull weathervanes. The rig is mounted on the turret, preferably with the rig spaced far from the riser upper ends. A gantry that is mounted on the hull and that supports the rotatable pipes that extend from the rotatable swivel parts, has a middle part that extends high above the turret deck to lie above the height of the top of the rig. A gantry can be used that has opposite ends lying on opposite sides of the turret, or a gantry can be used that has only one middle portion part that lies directly over the path of the rig as the gantry weathervanes over the rig, usually with such gantry having a cantilevered end.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An offshore production system for use in a sea location over a sea floor, which includes a floating hull rotatably connected to a turret to allow the hull to rotate about a primarily vertical turret axis about the turret, a mooring system that moors the turret to the sea floor to limit turret rotation, a fluid swivel device that has a plurality of fluid swivels that have rotatable swivel parts that rotate with the hull and that have nonrotatable swivel parts, a plurality of risers extending from wells in the sea floor to the nonrotatable swivel parts, and a plurality of conduits that extend from the rotatable swivel parts to the vessel hull, comprising:

a tubing-supporting rig mounted on said turret;

a tube extending down from said rig to the sea floor; and wherein:

said rig has a primarily vertical tube-supporting rig axis that is spaced from said turret axis;

said plurality of risers have parts lying at a bottom of said turret, that are centered on a primarily vertical riser axis that is spaced from said turret axis;

said riser and rig axes lying on primarily opposite sides of said turret axis.

2. The system described in claim 1 including:

a gantry fixed to said hull and having a portion extending high enough over said turret to lie above said rig;

said rotatable parts of said fluid swivel are supported on said gantry.

3. The system described in claim 2 wherein:

said turret has a top deck part; and including a nonrotating structure that extends upward from said top deck part and that is connected to one of said nonrotatable parts of said fluid swivel device to support said one of said nonrotatable parts of said fluid swivel and prevent said one of said nonrotatable parts from rotating.

4. The system described in claim 1 including:

at least one rotatable pipe that extends from said rotatable part of said fluid swivel device to said hull and that rotates with said rotatable part of said swivel device and with said hull;

a gantry having opposite ends fixed to said hull at opposite sides of said turret, and having a middle that supports said rotatable pipe, said middle having a portion that lies above said rig.

5. The system described in claim 1 wherein:

said turret has a top deck, and a plurality of said risers have upper ends lying at about the level of said turret top deck and extending primarily horizontally and away from said rig by a distance of at least one-half the radius of said turret to said rotatable swivel parts.

6. The system described in claim 1 including:

a manifold on said turret, that has an input connected to a plurality of said risers and that has an output connected to a single one of said nonrotatable swivel parts.

7. The system described in claim 1 including:

a swivel output pipe extending from the rotatable swivel part of one of said fluid swivels to said hull, said pipe having a part that lies over said turret at a greater height than a top of said rig.

8. An offshore production system that includes a vessel hull, a nonrotatable turret that is moored to the sea floor and that is supported on said hull by a bearing arrangement that allows said vessel hull to weathervane about said turret about a turret axis, at least one fluid swivel device with rotatable and nonrotatable swivel parts, and at least one riser that extends up from the sea floor and through said turret to said nonrotatable swivel part, comprising:

a gantry having a gantry end mounted on said vessel hull and having a gantry middle portion that lies over said turret, said gantry middle portion being capable of supporting weight by transferring the downward force of the weight to said gantry end, said rotatable swivel part lying above said turret deck and being attached to said gantry middle portion;

a tube-supporting rig mounted on said turret, said turret having a top deck and said rig projecting a plurality of meters above said turret top deck, the rig having a rig top lying a predetermined horizontal distance from said turret axis; a tube extending down from said rig to the sea floor;

said gantry middle portion has a gantry part lying above the height of said rig top above said turret top deck, so said gantry part moves over said rig top when the vessel hull weathervanes.

9. The system described in claim 8 including:

at least one rotatable pipe that extends from said rotatable part of said fluid swivel device to said hull and that rotates with said rotatable part of said swivel device and with said hull;

said gantry has a middle that supports said rotatable pipe, said middle having a portion that lies above said rig.

10. An offshore production system for use in a sea location over a sea floor, which includes a floating hull rotatably connected to a turret to allow the hull to rotate about a primarily vertical turret axis about the turret, a mooring system that moors the turret to the sea floor to limit turret rotation, a fluid swivel device that has a plurality of fluid swivels that have rotatable swivel parts that rotate with the hull and that have nonrotatable swivel parts, a plurality of risers extending from wells in the sea floor to the nonrotatable swivel parts, and a plurality of conduits that extend from the rotatable swivel parts to the vessel hull, comprising:

a tubing-supporting rig mounted on said turret at a location horizontally spaced from said turret axis, and a tube that extends down from said rig to the sea floor in an operating condition of the system, to assure that the rig and the tube do not rotate with respect to the risers.

* * * * *